United States Patent [19]

Narey

[11] Patent Number: 4,813,708

[45] Date of Patent: Mar. 21, 1989

[54] BALLOT FOR USE IN AUTOMATIC TALLYING APPARATUS AND METHOD FOR PRODUCING BALLOT

[75] Inventor: James O. Narey, Westminster, Calif.

[73] Assignee: Business Records Corporation, Santa Ana, Calif.

[21] Appl. No.: 22,396

[22] Filed: Mar. 6, 1987

[51] Int. Cl.[4] ..... B42D 15/00

[52] U.S. Cl. ..... 283/5

[58] Field of Search ..... 283/5, 48 R, 75, 106, 283/113; 250/566, 569; 346/139 R

[56] References Cited

U.S. PATENT DOCUMENTS

| | | | |
|---|---|---|---|
| 1,404,611 | 1/1922 | Hoag | 283/5 |
| 1,410,984 | 3/1922 | Baker . | |
| 2,190,019 | 2/1940 | Foster | 283/5 |
| 3,158,316 | 11/1964 | Clark | 283/5 |
| 3,294,424 | 12/1966 | Mathews | 434/306 |
| 3,708,656 | 2/1973 | Fielder | 283/5 |
| 3,870,865 | 3/1975 | Schneiderhan | 250/566 |
| 3,891,829 | 6/1975 | Dobras | 250/566 |
| 3,892,949 | 7/1975 | Dodson | 250/566 |
| 4,074,114 | 2/1978 | Dobras | 250/566 |
| 4,431,924 | 2/1984 | Souvamiemi et al. | 250/566 |
| 4,641,240 | 2/1987 | Boraum | 434/306 |

*Primary Examiner*—Paul A. Bell

*Attorney, Agent, or Firm*—Balogh, Osann, Kramer, Dvorak, Genova & Traub

[57] ABSTRACT

A ballot for use with a scanning device which reads the ballot and feeds it to a tallying or accumulating machine, the ballot being in the form of a base sheet possessing sufficient substance to facilitate the feeding of the ballot into the scanning device. The base sheet contains one or more columns of offices and the names of candidates who vie for the particular offices. Each margin of the ballot contains one or more index marks for correctly identifying the ballot orientation in the scanning device. One margin of the ballot also contains printed code marks by which the ballot style or configuration may be identified. Adjacent to each column of offices/candidates, are printed two columns of horizontally spaced timing marks, the timing marks being arranged on the lines bearing the candidate's names. A particular candidate is selected by introducing a mark between the horizontally spaced timing marks adjoining the particularly selected candidate. To visibly enhance markings between the two timing marks, the timing mark adjacent the candidate's name is in the form of an arrow head, and the other spaced timing mark is in the form of an arrow tail, so that a vote is cast when the arrow tail is connected by a line to the arrow head to thereby define a completed arrow.

8 Claims, 3 Drawing Sheets

BALLOT FOR USE IN AUTOMATIC TALLYING APPARATUS AND METHOD FOR PRODUCING BALLOT

FIELD OF THE INVENTION

This invention relates generally to improvements in a ballot for use in an automatic vote tallying or counting apparatus and to a method of forming such an improved ballot.

DESCRIPTION OF THE PRIOR ART

There are many forms of election ballots that have been prepared for overcoming one or more disadvantages in earlier existing ballots. For example, U.S. Pat. No. 1,404,611 describes a balloting system which uses a perforated card, wherein the perforations may be connected by slots to facilitate counting of such ballots by segregating means such as a probe in the form of a needle. Marking of such a ballot with a slot to interconnect joining holes adjacent a particular candidate's name appearing thereon is cumbersome.

Another form of a ballot has been described in U.S. Pat. No. 2,190,019, wherein two columns of spaced holes are used to define a list of candidates, one column of the holes being covered by tabs. The name of a particular candidate is selected by tearing away the tab to thereby disclose two spaced holes which are then used for counting purposes.

Also on the market, there are available different forms of electro-mechanical and electronic vote-tallying machines which are adapted to read marked ballots as they are inserted and passed through the machines. One of the main problems with the present available vote-tallying machines is that a large number of ballots are rejected or require a special counting treatment when the voter makes extraneous markings in the margin of the ballot. Sometimes, such extraneous marking triggers extraneous timing signals in addition to preprinted and properly spaced timing signals, so that the ballot is rejected and has to be reviewed by a judge at the polling place.

SUMMARY OF INVENTION

To overcome the various disadvantages of the different forms of ballots and the machines used for tallying the ballots, an improved form of ballot can be used with a particular method of optically scanning marks on the ballot to nullify extraneous markings. The improved ballot and related scanning method also prevent erroneous tally readings in the event that the ballot form is undersized and strays away from the prescribed path to be scanned by the optical scanner device.

According to the present invention, a ballot of cut flat sheet material is provided with two or more index marks which identify the orientation (top first, bottom first, face up, face down) of the ballot in an optical scanner device. Furthermore, the ballot is provided with a style code which identifies a particular list of election choices.

Furthermore, each ballot is provided with three columns within each scan track, wherein the inner column is initially void of any markings. A vote is cast by interconnecting the timing marks in the outer columns with each other by any form of marking such as a line extending between the two outer columns or by inserting another form of marking such as "X" or even a wiggly sign. To put more emphasis on the preferred selection of an election choice (i.e., a straight line), the two timing marks opposite the election choice appearing on the ballot are in the form of an arrow head and an arrow tail so that the arrow head and the arrow tail can be joined together by an intervening marking such as a line to define a completed arrow pointing to the selected election choice or candidate's name.

After the voting process is completed, the method of tallying the votes consists of optically scanning first, certain index marks to determine the orientation of the ballot in the scanning device, second, interpreting a style code to identify the nature of the offices or choices which are placed on the ballot, and finally, producing timing signals to strobe for markings in the central columns.

An object of the invention is to provide a method of producing the timing or clocking signals associated with self-clocking, optical mark sense reading systems.

Another object of the invention is to provide a means of minimizing the effects of skew on the reading system by permitting the printing of timing marks in close proximity to the data path which is to be optically scanned.

Another object of the invention is to provide a means whereby extraneous or inadvertent markings occurring in the timing or clocking path(s) of the document, can be effectively filtered out during scanning so as to minimize the occurrence of falsely induced timing signals causing rejection of the document.

Another object of the invention is to provide a method for detecting human choices or selections as indicated by the marking of a connecting line between appropriate pairs of preprinted timing marks.

A still further object of the invention is to provide pairs of timing marks which may be formed to resemble the heads of arrows on one side of the scanned path and the tails of arrows on the other side of the scanned path.

The method of implementing the objects of the invention is to provide read heads or reading units containing at least three sensing elements placed in a straight line within each read head, the orientation of the read head being such as to place the "in-line" sensing elements parallel to the timing marks and perpendicular to the direction of motion of the track to be scanned. The two outer sensors of each read head are used to detect the preprinted timing marks while the inner sensors are used to detect the presence or absence of a connecting line joining the timing marks.

The physical distance separating adjacent timing marks (arrow heads to arrow tails) and the spacing of the sensing elements within the read head are such that excessive lateral displacement of the scan truck on the document with respect to the read head will result in the loss of signal from one or another of the outer sensors before the inner sensor begins to produce a signal as a consequence of having detected a now mispositioned timing mark coming into its field of view. This provides that the loss of timing signal from either of the outer sensors can permit error detection and prevent the erroneous sensing of timing marks as meaningful data (selected choices).

The signals generated by the outer sensors in the read head are logically "AND"ed such that both signals must be present to constitute each valid timing signal.

There are at least two methods of accomplishing the "AND"ing function, i.e.:

a. The current summing of the two raw signals into a single "summing amplifier", such amplifier to produce usable output only when both sensor inputs are present (coincident).

b. The separate amplification of each raw signal and the input of the two logic level signals thus produced into a conventional logic "AND" gate.

There is real but not necessarily "obvious" benefit provided by the suggested "AND"ing of the timing signals.

In any self-timed mark sense system, a major disadvantage occurs as a result of careless users inadvertently placing stray marks in the timing tracks or columns. This frequently results in the invalidation of the ballot or document or portions thereof, by necessary error detection logic.

The "AND"ing of timing mark pairs requires that any stray marks must appear in both timing fields of a track and must be coincident in time to produce any detrimental effect on the reading system.

Further, the placement of timing marks (arrow heads and tails) in close proximity to the data field (connecting lines) absolutely minimizes the effects of skew on the reading system and requires only that the lateral displacement of the track to head relationship be controlled.

BRIEF DESCRIPTION OF THE DRAWINGS

The invention will now be described in conjunction with the following drawings, wherein.

DESCRIPTION OF THE PREFERRED EMBODIMENTS

Figure 1:
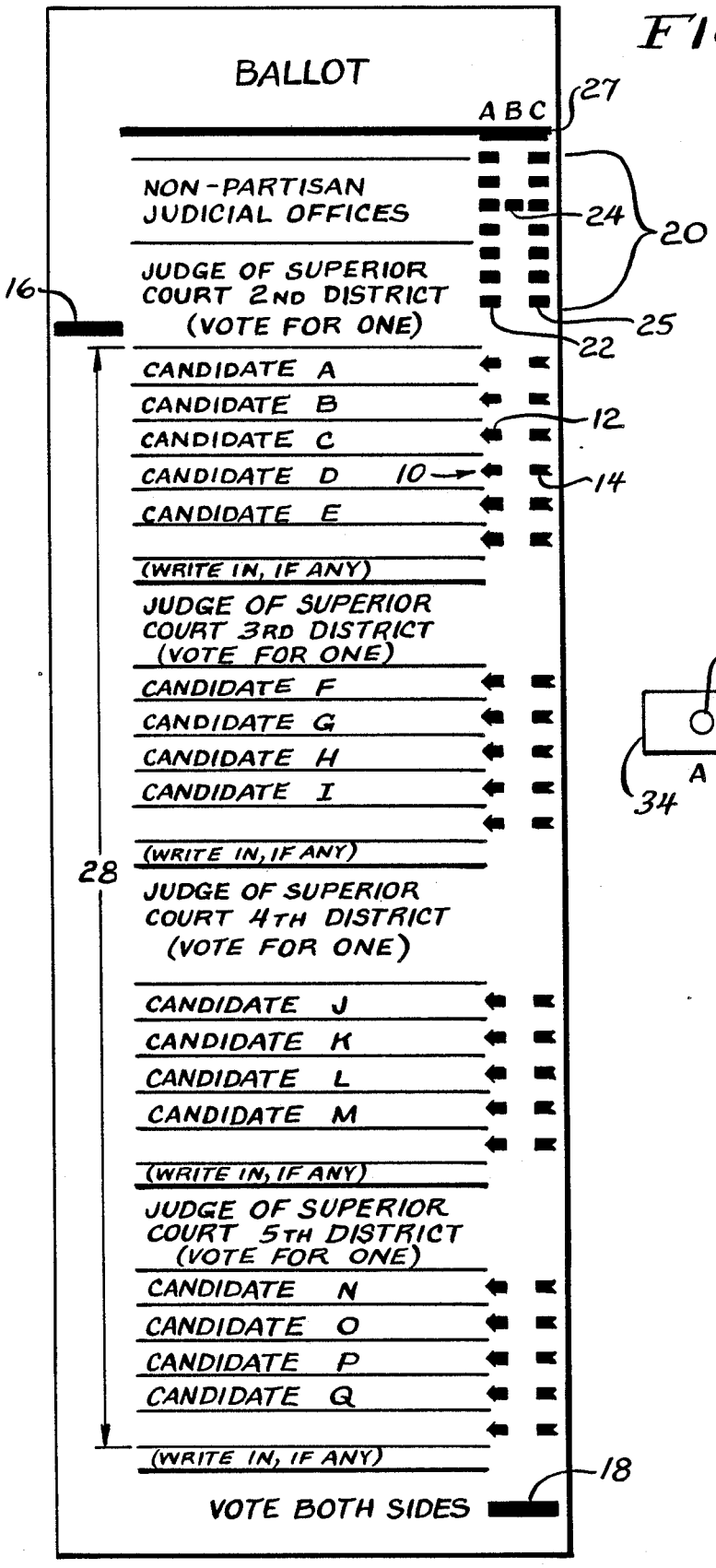
FIG. 1 illustrates a ballot for judicial offices.
Figure 2:
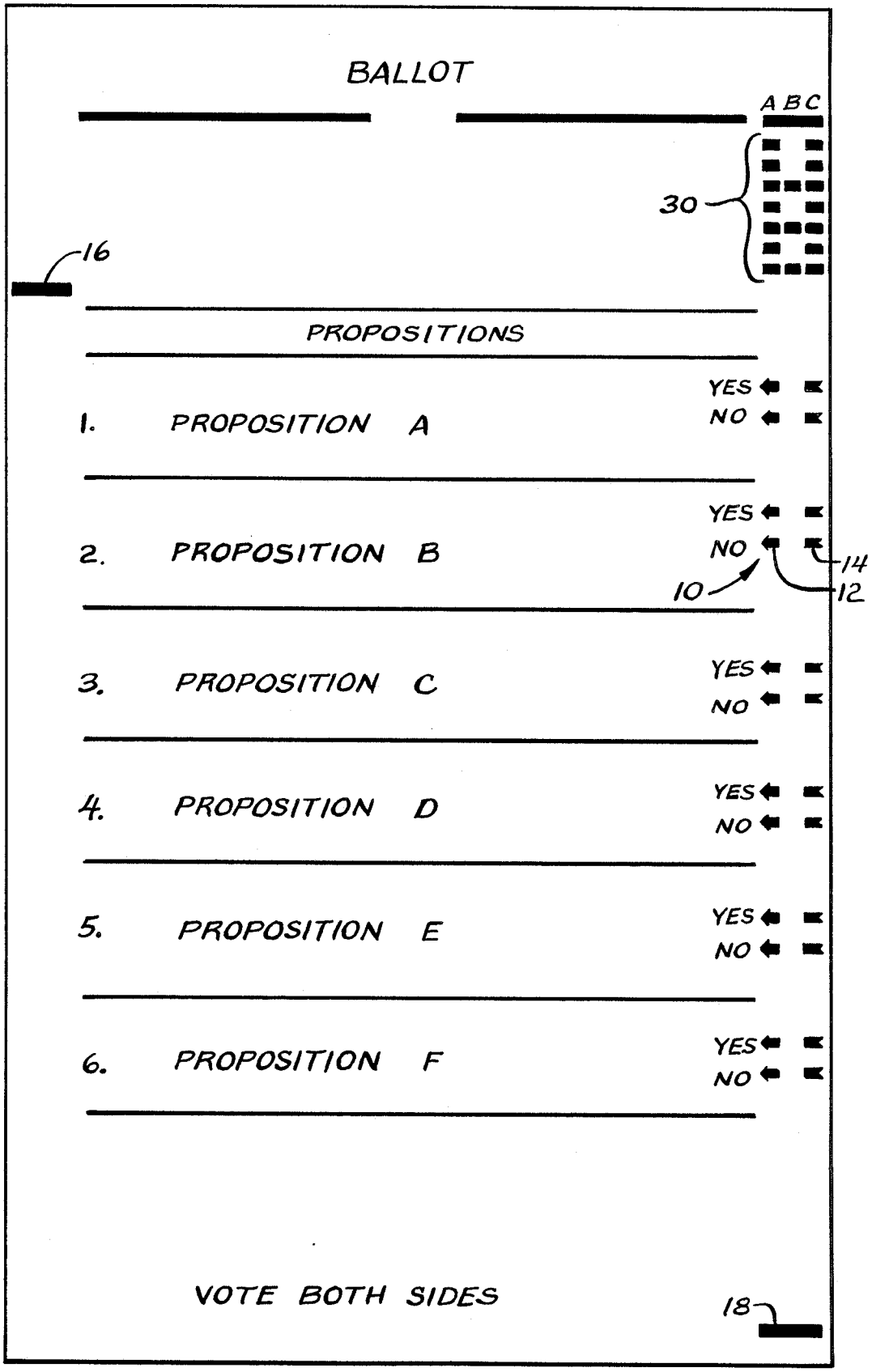
FIG. 2 depicts a ballot used for referendum voting.
Figure 3:
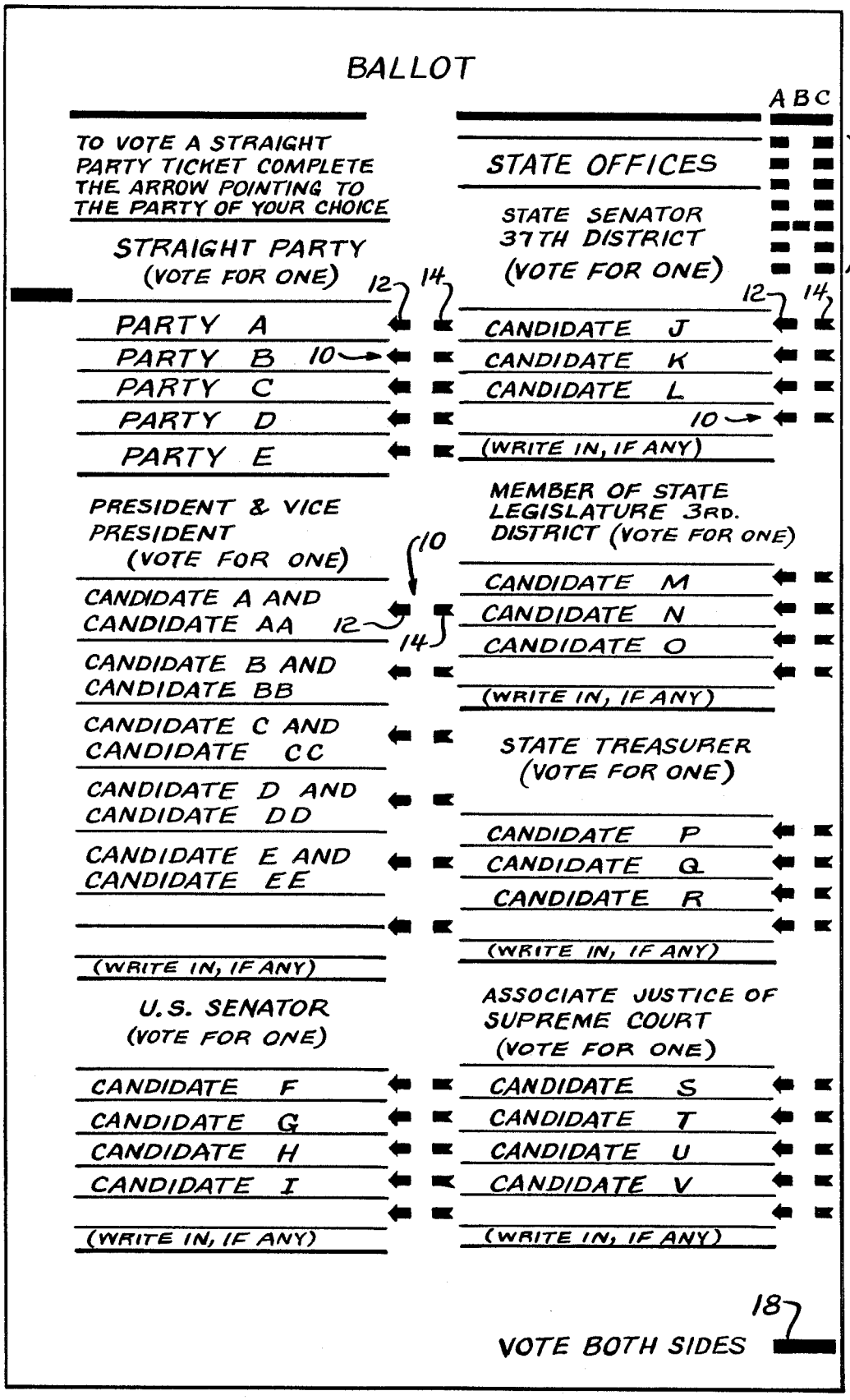
FIG. 3 shows a ballot containing two columns of candidates running for different offices.

Referring to FIGS. 1–3, there are shown three different ballots for different offices. These ballots are similar in one respect in that they contain timing marks 10 which are shown in the form of an arrow head 12 separated by a space from an arrow tail 14. Also, each of the ballots has index marks 16, 18, and 27.

The arrow heads 12 and arrow tails 14 serve only in pairs to constitute individual timing or indexing marks. As a ballot is transported longitudinally under the read sensor arrays, an arrow head/arrow tail pair must be sensed coincidently in time by separate sensing elements within each sensor array. Only then does an arrow head/tail pair constitute a valid timing mark. A third sensing element in each array is separately sensing the presence or absence of a mark appearing in the lateral space framed between each arrow head/tail pair. Such mark, when present, and coincident with a timing mark, represents the voter's choice or preference.

Referring to FIG. 1, the ballot has a style or configuration code 20 located in the upper right-hand side. The style code 20 comprises timing marks 22 and 25 along with numerically assigned value binary data marks 24. When this ballot is placed into a scanning reader, the binary coded style number is read to determine the identity and location of the particular choices listed on the ballot. Columns A and C include seven bars, and each row of the seven bars has a unique assigned numerical value. The bars in the columns A and C are timing marks and, between them, is a binary data bit, either 1 or 0, calling for the inclusion or exclusion of its assigned numerical value in forming the sum which represents the encoded style number.

The index mark 27 above the right-hand column of the style code 20 serves as a demarcation mark which alerts the reading system to the coded information which follows.

The index mark 16 on the left of the ballot also serves as a demarcation mark which alerts the reading apparatus to stop reading the style code 20 and to start reading the body of the ballot. The assignment of the style code data bits are from the bottom to the top, in binary counting places, hence, 1, 2, 4, 8, 16, 32, 64, to constitute the seven positions on the style code 20.

The remaining portion or body of the ballot constitutes a candidate list 28 which extends from the first-named candidate (or election choice), to the last line, which is reserved for a write-in vote. In connection with the reading of the body of the ballot, the reader apparatus reads the timing marks 12 and 14. In between these timing marks, that is, in column B, an inserted mark will indicate a vote, and no mark will indicate an absence of a vote.

Referring to the ballots shown in FIGS. 2 and 3, it is apparent that a style code 30 on the ballot in FIG. 2 is different from the style code 32 shown in FIG. 3, and the style code 20 on the ballot shown in FIG. 1 is different from the style codes on the other two ballots.

Although the timing marks 10 are shown as being printed on the ballot, it is obvious that the timing marks could be in the form of slots, holes, or other forms of indicia which can be readily scanned by an optical device.

Figure 4:
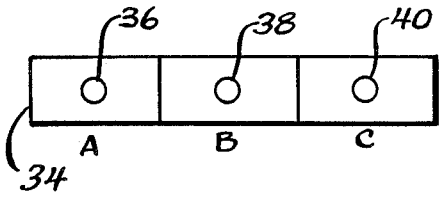
FIG. 4 shows an "in-line" arrangement of sensing elements in a read head used for scanning the different markings on the ballots.

As shown in FIG. 4, a read head 34 has three sensing elements spaced from each other in a straight line to identify with the scanning positions of Columns A, B, and C. The left and right sensing elements 36 and 40 must see or sense marks in Columns A and C, while sensing element 38 in the middle, searches for a mark placed by a voter in the Column B.

With the arrangement of pairs of spaced timing marks, it is apparent that "X"'s, checks, or wiggle lines can all constitute a proper marking to be counted as a vote, as long as some portion of the mark, as detected by the center sensor, is coincident with the timing mark pairs being detected by the outer sensors.

This arrangement can work with a ballot which supports one, two, or more columns of offices or selections. For example, FIG. 3 illustrates a ballot having two ballot columns.

In order that the ballot, as described herein, function properly, certain criteria must be met during ballot preparation. The ballot has to be prepared on a base, such as stiff paper or cardboard, or any other equivalent suitable material, so that it has sufficient substance for proper insertion into the scanning or tallying machine. Once a selection has been made of the proper material to support markings on the ballot, generally, the face or both faces of the base can be imprinted to bear the names of the candidates running for the particular political offices. In order that the ballot be properly processed in the scanning machine, it is preferable to apply at least two index markings, one or more in each margin along the longitudinal length of the base. Using these index markings, a properly programmed tallying device may correctly allocate the detected votes regardless of the orientation (face up, face down, head first, tail first) in which the ballot is inserted.

In virtually any election, a variety of different ballot styles is required to meet the various geographical and political needs of a voting jurisdiction. For example, in party primary elections, several different styles of ballots, each containing the candidates of different political parties and all containing in common, questions and issues applicable to the district, may be inserted at random into the single scanning/tallying devices located in each precinct.

To identify the particular groups of offices, candidates, issues and propositions which may appear on any particular ballot, it is necessary to apply a machine-readable style code to the base. Upon insertion of any voted ballot for which a scanning/tallying machine has been properly programmed, the style code serves to permit correct allocation of detected votes to the proper tally position counters.

The method of preparing the ballot also includes the steps of applying along the longitudinal margins of each column of offices/candidates, two columns of timing marks. In other words, opposite each candidate's name, there is a pair of spaced timing marks. The spacing between the timing marks should be wide enough to easily accept a marking by the voter and must bear an exact physical geometry with respect to the reading head design of the scanning device. As previously mentioned, it is not necessary that the two spaced timing marks be connected into an integral unit. The reading head will register a vote as long as the two spaced timing marks are properly read by the sensing elements 36 and 40, and providing that there is some indication of a vote mark between the timing marks to be read by the centrally-located sensing element 38. The two columns of the timing marks define therebetween a vote recording channel or scanning tract for receiving candidate selection marks applied by the voter.

In order to assist the voters in visualizing their candidate selection, the timing marks located in Column A are in the form of an arrow head which points toward the candidate's name, while the timing marks located in the Column C are in the form of an arrow tail, making it obvious to the voter that the connection of the arrow head with the arrow tail will define a completed arrow which will indicate a qualified vote for the particular candidate.

From the foregoing description, it is obvious that any extraneous marks which may be made by a voter outside of the voting channel as defined by the space between the left and right timing marks, will not be recorded as a vote. Furthermore, extraneous markings which do not appear simultaneously in the field of view of both the left and right outer sensors of a scan track will not result in false timing signals and rejection of the ballot.

Furthermore, it is clear that the timing marks need not necessarily be in the form of printed symbols, but may be of some other form, for example, as apertures in the ballot, so that the scanning machine and its reading head will read only vote recording marks which are placed between the two symbols.

Other modifications of the present invention within the scope of the appended claims may be made without departing from the spirit of the invention.

What is claimed is:

1. An election ballot adapted to be read by a scanning apparatus provided with read sensor arrays, which apparatus feeds the scanned data to a tallying machine programmed to properly allocate votes according to the voter's selection, said scanning apparatus scanning information on the ballot as it moves longitudinally through said scanning apparatus, comprising an elongated base sheet, a style code printed in one longitudinal margin of said base sheet, spaced timing marks adjacent each selection choice, and at least two or more index marks printed on said base sheet, each margin having at least one of said index marks for properly determining orientation of said ballot in said scanning apparatus.

2. A ballot according to claim 1, wherein said style code includes a plurality of printed code marks arranged in at least three columns located in the right hand margin of said base sheet, said code marks arranged to provide digital output which may be interpreted as a binary number, said spaced timing marks being arranged in timing mark columns to be in line with the columns of said style code, the spaced timing mark columns defining therebetween a vote recording channel to receive a vote recording mark made by the voter between spaced timing marks adjacent a selected voter's selection.

3. A ballot according to claim 1, wherein each timing mark in the column next to the listed selection choice is in the form of an arrow head pointing to the selection choice, and the timing mark in the column most remote from the listed election choices is in the form of an arrow tail, whereby a voter indicates the selected choice by interconnecting the arrow tail to the arrow head on the line identifying the selection choice.

4. An election ballot adapted to be processed by a vote-selection scanning apparatus provided with read sensor arrays, which apparatus feeds information to a tallying machine programmed to properly allocate the vote selection according to proper classification, said scanning apparatus scanning information on the ballot as it moves longitudinally through said scanning apparatus, said ballot comprising an elongated base sheet, two or more indicia positioned in predetermined locations in longitudinal margins of said base sheet for orienting the scanning with respect to the inserted position of the ballot in the apparatus, a style code positioned adjacent one corner of said base sheet to identify the classification of the selection choice, and timing marks positioned in two spaced columns adjacent to each column of offices/candidates, said timing marks being arranged adjacent each selection choice printed on the ballot, said two spaced columns of timing marks defining therebetween a vote recording channel to be marked by the voter by connecting two opposed timing marks associated with a selected candidate.

5. A ballot according to claim 4, wherein said style code contains a plurality of indicia arranged in three vertical columns which are disposed in line with the spaced columns containing said timing marks and the vote recording channel, whereby said timing marks produce timing signals to strobe for markings in said vote recording channel.

6. A ballot according to claim 4, wherein the timing marks in the column adjacent the selection choices are in the form of arrow heads pointing to the selection choices, and the timing marks in the other column are in the form of arrow tails, whereby placing a linear mark connecting a particular arrow tail to its associated arrow head will constitute a vote for the selected choice.

7. A method of producing a voting ballot, comprising the steps of selecting a base of elongated sheet material capable of trouble-free insertion into a talling machine, imprinting said base to bear names of election choices, applying an index marking along each longitudinal margin of said base, applying a style code along one longitudinal margin of said base to identify said ballot with particular election choices printed on the ballot, and applying along one of the longitudinal margins, opposite each election choice, a pair of timing marks, horizontally spaced by predetermined distances, said timing marks defining therebetween a vote recording channel for receiving election choice marking applied by the voter.

8. A method according to claim 7, wherein the step of applying pairs of timing marks comprises the step of imprinting arrow heads pointing towards the printed election choice and imprinting arrow tails spaced from said arrow heads to define said vote recording channel.

* * * * *